US005673901A

United States Patent [19]

Heinrich

[11] Patent Number: 5,673,901

[45] Date of Patent: Oct. 7, 1997

[54] DEVICE FOR TRANSPORTING MOLTEN METAL IN THE POURING BAY OF A SHAFT FURNACE AND PROCESS FOR OPERATING THIS DEVICE

[75] Inventor: Peter Heinrich, Geldern, Germany

[73] Assignee: MAN Gutehoffnungshütte Aktiengesellschaft, Oberhausen, Germany

[21] Appl. No.: 686,032

[22] Filed: Jul. 25, 1996

[30] Foreign Application Priority Data

Aug. 31, 1995 [DE] Germany ..... 195 32 040.9

[51] Int. Cl.[6] ..... C21B 7/14

[52] U.S. Cl. ..... 266/196; 266/197

[58] Field of Search ..... 266/135, 136, 266/196, 197, 271, 157

[56] References Cited

U.S. PATENT DOCUMENTS

| | | | |
|---|---|---|---|
| 3,262,692 | 7/1966 | Adams et al. | 266/196 |
| 3,365,187 | 1/1968 | French et al. | 266/196 |
| 3,389,898 | 6/1968 | Schimmel et al. | 266/196 |
| 4,208,041 | 6/1980 | Jordanov et al. | 266/196 |
| 4,475,720 | 10/1984 | Broom et al. | 266/157 |

FOREIGN PATENT DOCUMENTS

| | | |
|---|---|---|
| 395 320 | 4/1992 | Austria . |
| 0 279 165 B1 | 1/1988 | European Pat. Off. . |
| 26 19 534 | 11/1977 | Germany . |
| 28 50 287 A1 | 5/1979 | Germany . |
| 31 32 811 A1 | 4/1982 | Germany . |
| 32 30 762 A1 | 3/1983 | Germany . |
| 31 31 567 C2 | 11/1984 | Germany . |
| 36 24 266 | 1/1988 | Germany . |
| 39 30 444 C1 | 2/1990 | Germany . |
| 29 04 415 | 4/1990 | Germany . |
| 40 33 482 | 2/1992 | Germany . |
| 2 049 136 | 4/1980 | United Kingdom . |
| 2 084 705 | 8/1981 | United Kingdom . |
| WO 90/08842 | 12/1989 | WIPO . |

OTHER PUBLICATIONS

Klaus Grutzmacher et al., Mar. 15, 1991, Staubunterdrückung in Hochofengiesshallen, *Stahl U. Eisen,* No. 3, No Translation.

Paul Van Ackeren et al., May 28, 1994, Fortschritte in der Arbeitstechnik und Entstaubung der Giesshallen Neuer Hochofen, *Stahl U. Eisen,* No. 11, No Translation.

*Primary Examiner*—Scott Kastler

*Attorney, Agent, or Firm*—McGlew and Tuttle

[57] ABSTRACT

A device for transporting molten metal in the pouring bay of a blast furnace and a process for operating this device. At least one main runner with skimmer, which main runner is installed after the tapping door of the blast furnace, is provided as well as runoff gutters arranged downstream with a transfer station into the molten metal transfer cars. A pipe section with connecting branches, which is followed by a second pipe section with a slide, is flanged to the runout in a gas-tight manner. This second pipe section is also connected in a gas-tight manner to the intake opening of the main runner. A T-shaped pipe section, which allows the pig iron to flow into one of the pig iron transfer cars, is arranged at the end of the pipe sections. To keep clear the open cross section of the wear lining of the pipe section, inert gas is blown in, which also keeps the ceramic plate of the sliding shutter clear.

11 Claims, 4 Drawing Sheets

DEVICE FOR TRANSPORTING MOLTEN METAL IN THE POURING BAY OF A SHAFT FURNACE AND PROCESS FOR OPERATING THIS DEVICE

FIELD OF THE INVENTION

The present invention pertains to a device for transporting molten metal in the pouring bay of a shaft furnace, especially a blast furnace, and to a process for operating this device, which comprises at least one main runner with a skimmer, which main runner is installed after a tapping door of the blast furnace as well as runoff gutters arranged downstream with a transfer station into the molten metal transport vessels or transfer carts.

BACKGROUND OF THE INVENTION

The pouring bay technique of blast furnaces has not seen any fundamental change during the past decades. The taphole is still drilled open for each tapping of molten metal, and it is then plugged again. Even though improved plugging compositions were developed, and the plugging capacity (1/sec, kg/cm$^2$) as well as the drilling capacity (depth of drilling, torque, impact drilling) have improved, opening and closing of a blast furnace runout at the correct time still depends to some extent on chance. Even though the introduction of bars—the knock-out technique, in which a steel bar is introduced into the freshly plugged taphole, and it is knocked out in the rearward direction for the next tapping—has brought with it certain improvements during opening, the problem has not yet been solved in a satisfactory manner.

The separation of the molten metal into pig iron and slag based on their different specific gravities continues to take place in the so-called main runner. For the past few years, main runners have been designed as so-called pool runners of a relatively large size, in which a molten residue of pig iron is always left behind. Runners with a length of 12 to 15 m and a width of 2.0 to 2.5 m are typical for large blast furnaces. Such large and also heavy runners, weighing up to 250 tons after a fresh lining, are difficult to replace and require very heavy cranes for their handling, which in turn run on a heavy bay structure. Many mills have therefore decided to design the main runner as a stationary runner rather than as a replaceable runner. The drawback is that after producing 0.6 to 0.8 million tons of pig iron, it is necessary to repair the refractory lining, which takes several days and must be carried out under unfavorable conditions in the pouring bay. The runout in question cannot be used during this time.

The quick-change runner known from EP 0 279 165 B1 has brought progress here. This runner is designed for replacement in less than 8 hours, so that the replacement can be performed within one normal repair shift. No heavy crane is required for the replacement; the worn runner is lowered onto a special vehicle by means of hydraulic lifting devices, and a freshly lined runner is picked up with the same lifting devices from a second vehicle. The cooling, clearing and relining of the runner takes place under the conditions of the shop outside the area of the blast furnace.

In the main runner, the molten metal first flows through a siphon (skimmer) to separate pig iron and slag; the slag-free pig iron then flows through open runners lined with refractory material, but mostly they are also covered, like the main runner, with plates or hoods, to the various places where the pig iron transfer cars are waiting. To specifically reach these waiting places, baffle plates lined with refractory material are pulled one after the other, or so-called tipping runners with electric or hydraulic drive are used.

The slag separated at the skimmer leaves the main runner and via runners, which are open or are also covered with hoods, it enters a slag ladle, a granulating device with water, or it solidifies due to natural cooling in a slag bed consisting of sand.

Caring for the pig iron and slag runners and keeping them clean is the chief cause of the heavy manual work that needs to be performed in pouring bays even if machines are used whenever possible.

Red dust (Fe oxide) is generated especially at the taphole, the tipping runner, as well as at the pig iron inlet into the transport vessel, and, to a lower extent, also at the pig iron and slag runners covered with hoods as well as at the main runner. This dust is formed as a consequence of the contact of the hot pig iron with the ambient air. To remove the red dust, dust separators designed for high exhaust volumes are installed according to the current technique. These dust separators consist of a system for capturing the dust (hoods, pipelines), and a plurality of strands that can be switched over and are to be provided for blast furnaces with a plurality of tapholes. This in turn requires fittings of large diameters, corresponding actuating drives, and a control logic. The amounts of air drawn off are on the order of magnitude of a few 100,000 Nm$^3$/hr. to far above 1.0 million Nm$^3$/hr., depending on the number of taps and the size of the pouring bay. In the case of intense suction, the contact of the hot pig iron with air is inherently intensified, and the amount of dust per ton of pig iron increases.

Correspondingly large fabric filters or electrostatic precipitators are installed to separate the dust. A ventilator station, whose drive power may easily reach a few MW, depending on the amount extracted and the pressure loss of the system, is to be provided before or after the filters. The cleaned gas is released into the atmosphere via a stack.

The disposal of the dusts, which often contain Zn and Pb, requires additional devices (e.g., pelletizing pan, surge bins), and increasing environmental requirements make it increasingly more problematic.

On the whole, the above-described dust separators require considerable investment and operating costs. It is therefore not surprising that numerous suggestions for avoiding/suppressing the generation of dust have been described in the literature, and some of them have also been implemented in practice.

Devices for bulkheading/encapsulating the flow of pig iron by mechanical devices, such as hoods, covers, and the like have been known.

DE 39 03 444 C1 discloses a process and a device for preventing pig iron from coming into contact with air by screening with an inert gas, e.g., nitrogen, in which, beginning from the tapping door of the metallurgical furnace, the runoff gutters, which guide the molten metal, are covered by forming a free interior space of the smallest possible volume, through which no molten metal flows; and the transfer point, at which the molten metal is passed on from the transport runner into a casting vessel, is screened in an extensively gas-tight manner, wherein both the free interior space of the covered runoff gutters and the interior space of the transfer point, which is screened in an extensively gas-tight manner, and the interior space of the casting vessel are rinsed with inert gas. The jet of molten metal running off is additionally screened by a ring-shaped pressurized inert gas jacket, which prevents air from entering, from the discharge opening into the casting vessel.

The device comprises at least one transport and runoff gutter installed at a tapping door of the metallurgical furnace, a transfer station with a pivoting or tipping runner, and a distribution system for the molten metal into a casting vessel, wherein each transport and runoff gutter has over its entire length one or more cover hoods, which form the smallest possible free interior space, i.e., an interior space through which no molten metal flows.

The transfer stations, including the discharge openings, are screened by a dosed housing in an extensively gas-tight manner.

Nozzles for supplying inert gas are provided in the cover hoods and in the transfer station housing.

The drawback of this tapping system is the thermal current caused by the high temperature of the pig iron, which requires a continuous supply of more inert gas.

SUMMARY AND OBJECTS OF THE INVENTION

The object of the present invention is therefore to guarantee a reliable and rapid opening and dosing of blast furnace tapholes at the correct time, to make it possible to suppress the dust formation in the areas of the taphole, the main runner, the pig iron and slag runners, to achieve a reduction in manual work in the area of the runners, and to contribute to a reduction in the investment and operating costs.

According to the invention, a device for transporting molten metal is provided in the pouring bay of a shaft furnace. The device for the shaft furnace, especially a blast furnace, comprises at least one main runner with a skimmer, which main runner is installed at the tapping door; runoff gutters; as well as a transfer station into the molten metal transport vessel or transfer ear. A tanged pipe section is provided with a connecting branch for a boring machine. Another connecting branch for a taphole gun is provided between the runout on the said blast furnace and the said main runner. An inert gas supply means and a slide with a ceramic plate are arranged between the tanged pipe section and the said intake opening of the said main runner. The main runner, with a siphon, is sealed in a gas-tight manner with a cover hood with a flap.

A slide with a ceramic plate is arranged between a discharge opening of the said main runner and a metal pipe section. The metal pipe (or pipes) is (are) arranged between the slide and a T-shaped pipe section. One slide is arranged between the said T-shaped pipe section and each of the elbows.

The inert gas supply means is preferably arranged at the intake opening, the discharge opening, and the flap. An inert gas screen is preferably provided at the elbows. The stationary boring machine is preferably provided at the connecting branch; a stationary taphole gun is preferably provided at the connecting branch; and a stationary taphole boring machine is preferably provided above the said hood at the said flap.

A pipe clamp with laterally arranged feed lines and shut-off valves is preferably provided to seal the pipe sections, a pipe section with the sliding shutter as well the pipe sections among each other, the T-shaped pipe section with pipe section or with one of the elbows.

A wire screen as well as a metal pin of an electric measuring device are preferably provided in the pipe sections at the transition from the outer lining to the wear lining. A burner is preferably arranged on one of the pipe sections. The main runner is preferably equipped as a quick-change runner.

The invention further includes a process for operating a device for transporting molten metal in the pouring bay of a shaft furnace, especially a blast furnace and for achieving opening and closing of the runout at the correct time for accurately metering the amount of molten metal in such a way a) that to open the plugged taphole, a taphole boring machine drills out the hardened plugging composition within the pipe section of the taphole and of the runout after opening the ceramic plate of the sliding shutter and after opening a closing cap on the top side of the cover hood of the main runner;

b) that after opening the taphole, a flow of molten metal flows through the pipe section, the opened sliding shutter, and the intake opening into the gas-tightly screened main runner with the skimmer; that after separation of the slag, the flow of pig iron flows through the discharge opening and through at least one metal pipe into a T-shaped pipe section and it reaches from there a pig iron transfer car via one of the opened sliding shutters through an elbow;

c) that immediately after dosing a sliding shutter arranged in the pipe section, the taphole is cleared of molten metal by rinsing by means of an inert gas, and that this state is maintained by setting a specific inert gas flow rate;

d) that for plugging/repairing the taphole washed out by the flow of molten metal or for replacing the ceramic plate of the sliding shutter, the taphole of the runout is cleared by rinsing by means of an inert gas, that the connecting branch of the pipe section is drilled by means of a drill bit of a stationary boring machine to clear it of hardened plugging composition, that the drill bit of the boring machine drills a channel into the hardened plugging composition of the taphole and then clears the connecting branch of the taphole gun by drilling;

e) that to introduce plugging composition through the taphole gun via the connecting branch, plugging compositions are moved within the pipe section in the direction of the taphole, the connecting branch and the ceramic plate of the sliding shutter, but the ceramic plate of the sliding shutter is protected from the further advancement of the plugging composition and is kept free for replacement by an inert gas blanket.

Further, according the process, to avoid pig iron runs in joints after repair work, the pipe sections, the metal pipe sections, the T-shaped pipe section, and the elbow are preferably connected tightly by introducing a plastic plug and a sealing compound.

A pipe section lined with refractory material is arranged according to the present invention between the runout on the blast furnace shell and the main runner. A stationary boring machine and a stationary plugging machine are arranged on both sides of the pipe section. The pipe section itself is provided for this purpose with two connecting branches, through which the drill bit of the boring machine or the blowpipe of the taphole gun is led.

A ceramic sliding shutter, which has been known as a shutter for steel casting ladles from steel-making technology, is installed on the side of the pipe section facing the main runner. Inert gas connections with control valves are arranged immediately before and after the sliding shutter.

The opening and closing of the taphole are carried out as follows:

In the normal case, the ceramic sliding shutter is opened for tapping, and it is again closed. Immediately after closing, the taphole is rinsed via the inert gas connection to clear it of pig iron, and this state is maintained by automatically setting a small inert gas throughput. The pig iron is thus prevented from solidifying in the taphole and from blocking the sliding shutter.

From time to time, it is necessary either to repair the taphole washed out by the flow of pig iron by plugging, or to replace the ceramic plate of the sliding shutter.

In these cases of repair, the ceramic sliding shutter is dosed at the end of the tapping, and the taphole is rinsed with inert gas via the connection to clear it of pig iron. The stationary boring machine is then actuated; it first clears one of the connecting branches, to which it is flanged itself on the pipe section, of hardened plugging composition by drilling. The drill bit then passes through the taphole and drills a channel into the hardened plugging composition, which fills the other connecting branch, with which the stationary plugging machine is tanged on the pipe section. The drill bit is then withdrawn into its starting position, and the taphole gun is actuated. The plugging composition fills the taphole in the direction of the blast furnace; plugging composition advances at the same time in the direction of the stationary boring machine to the tip of the drill bit, and the plugging composition also advances at the same time toward the sliding shutter, but without quite reaching the ceramic sliding plate, because an inert gas blanket is formed in front of the latter.

For the subsequent opening of the taphole, a second boring machine, arranged above the main runner in an oblique position—slope about 6°, corresponding to the slope of the taphole—is actuated after the opening of the ceramic sliding shutter after opening a flap screened with inert gas.

This boring machine drills up the taphole through the pipe section as well as through the refractory lining located within the shell. As soon as the taphole is clear, the drill is withdrawn, and the flap is dosed. To collect the dust inevitably generated during this drilling process, a dust separating line, which leads to a small filter unit, operated for the duration of the drilling process only, is connected to the exhaust hood.

As was explained above, the main runner is covered by a cover hood. The connection between the main runner and the cover hood is designed in the known manner such that the access of outside air to the pig iron bath located within the main runner is extensively suppressed, e.g., by means of a sand seal. The cover hood is designed as a cover hood that can be mechanically raised and lowered and laterally displaced to grant rapid access to the main runner for inspections and possibly for repairs on the refractory material.

A siphon (skimmer), which separates the molten metal into pig iron and slag based on their different densities, is located at the end of the main runner. While the slag is transferred to a granulating unit, a slag ladle, a slag pit or a slag bed via open or covered runners after leaving the main runner in the prior-art manner, the molten pig iron is no longer transported to the waiting places of the pig iron transfer cars in runners, as before. Instead, metal pipes lined with multiple layers of refractory material are used; arranged from the outside to the inside, these metal pipes have an insulating layer, an outer lining, and a wear lining. These metal pipes are divided into lengths of 1–2 m, so that the relatively low weight makes handling with a light-weight lifting gear possible. A wire screen is arranged between the wear lining and the outer lining; furthermore, each pipe section has a metal pin, which passes through the entire refractory lining from the inside to the outside and is in contact with the molten pig iron when it is flowing through the pipe section. Using a suitable electric circuit, it is possible to instantaneously recognize when the wear lining is worn off at a point by the molten pig iron to the extent that the pig iron comes into contact with the wire screen. The pipe section in question can be replaced at the next opportunity at a low cost, and a freshly lined pipe section can be inserted.

The pipe system is provided with corresponding branches, so that it can supply all the intended waiting places. The flow of pig iron is switched over from one waiting place to the next by means of remote-controlled ceramic sliding shutters.

Such a heating offers the advantage that the pig iron does not solidify, on the one hand, and the refractory lining is not subject to any thermal shock stress.

In addition, another ceramic sliding shutter is provided at the beginning of the pipe system behind the main runner. The pipe system can be shut off with the latter sliding shutter toward the main runner. This makes it possible to heat the pipeline system by one burner, which guarantees that the hot burner gases will heat the pipe system over its entire length; they escape at the elbows at the waiting place of the pig iron transfer cars, rather than toward the main runner.

Guiding the molten pig iron in a fully encapsulated and filled pipeline system prevents the access of air and consequently the formation of dust over this part of the transport path.

To suppress dust at the waiting places, the elbow is pulled downward as much as possible (limitation: clearance). To prevent dust from forming even over the inevitable, remaining free fall section, an inert gas screen is used here in the known manner.

The durability is increased by lining the pipes with high-quality refractory materials. Replacement of the pipes is necessary only rarely. It is performed only when the wear has reached a predetermined extent. The pipes are cleared after cooling under shop conditions, outside the pouring bay.

The main runner is designed as a quick-change runner. No heavy lifting gear is needed for this purpose; the used main runner is lowered and the new main runner is raised with a hydraulic lifting device, e.g., one known from EP 0 279 165 B1.

The cooling, clearing, and relining of the heavy replaceable runner is carried out under shop conditions outside the pouring bay. The amount of work to be performed in intense heat is reduced and the working conditions become more efficient due to the above-described measures.

Last but not least, the above-described design of the blast furnace pouring bay technology leads to a quite substantial reduction in investment; the heavy pouring bay crane that was previously necessary is eliminated, and only a light-weight lifting gear of a small span is required. The bay area needed and the weight of the steel structure are quite considerably reduced. The expensive hoods and pipeline systems for capturing dust within the pouring bay are eliminated, and so is the large filter unit with the blower station, stack, and dust silo. The operating costs are considerably reduced due to the reduced cost of operating the filter station—maintenance, the cost of power for the blower—as well as the elimination of the cost for the removal and disposal of the dust.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
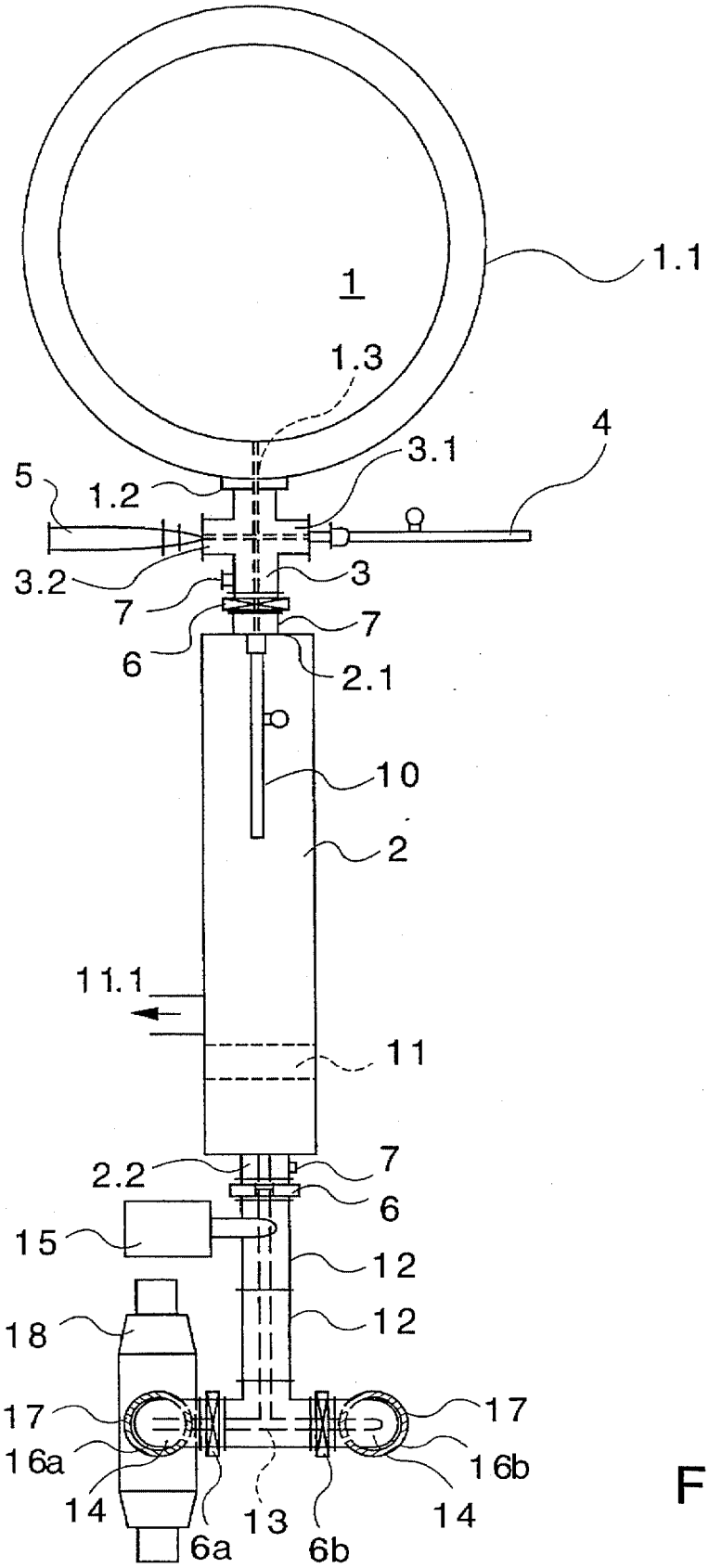
FIG. 1 is a top view of the tapping system.

Referring to the drawings in particular, FIG. 1 shows a top view of the tapping system or one of the molten metal transport units of a blast furnace 1 with a runout 1.2 with taphole 1.3 arranged in the blast furnace shell 1.1.

A pipe section 3 with a connecting branch 3.1 for a stationary boring machine 4 and with a connecting branch 3.2 for a stationary taphole gun 5 are flanged to the runout 1.2. The pipe section 3 is joined by a slide 6 with a ceramic plate and the intake opening 2.1 of the main runner 2.

A number of pipe sections 12, which are lined with refractory material and open into a T-shaped pipe section 13, are connected in a gas- or air-tight manner to the discharge opening 2.2 after the main runner 2 with the siphon skimmer 11 for separating the pig iron from the slag. A slide 6*a* and 6*b* each are arranged on both discharge sides of the T-shaped pipe section 13 between the downwardly directed elbows 14 with an inert gas screen 17 to guide the molten pig iron to one of the waiting places 16*a*, 16*b*, where it can flow off into the pig iron transfer car 18.

Inert gas supply means 7 are arranged on the pipe section 3 before and after relative to the direction of flow of the pig iron of the Slide 6 at the intake opening 2.1 of the main runner 2. Another insert gas supply means 7 is arranged at the discharge opening 2.2 of the main runner 2. A burner 15 for heating the pipe sections 12 is arranged in the first pipe section after the main runner 2.

Figure 2:
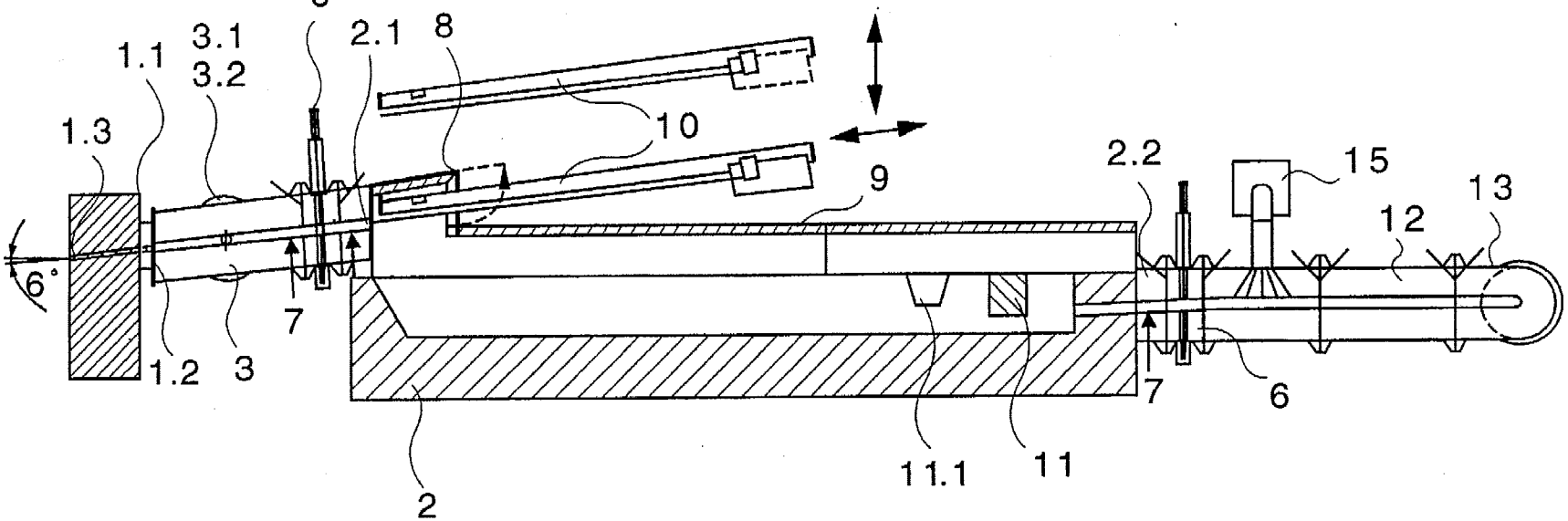
FIG. 2 is a longitudinal section in the area of the main runner.

FIG. 2 shows a longitudinal section through the front part of the liquid (molten metal) transport unit. A pipe section 3 with connecting branches 3.1, 3.2, to which a second pipe section 3 with a slide 6 is connected, is flanged to the runout 1.2 in a gas-tight manner. This second pipe section 3 is also connected in a gas-tight manner to the intake opening 2.1 of the main runner 2. A pipe section 12 with a slide 6, to which additional pipe sections 12 are joined if needed, is first flanged to the discharge opening 2.2 of the main runner 2. A T-shaped pipe section 13, which allows the pig iron to flow into one of two pig iron transfer cars, is arranged at the end of the pipe sections 12.

The main runner 2 is designed as a quick-change runner. After the refractory lining has been worn, it is lowered onto a transport vehicle standing on the bay floor from the operating position at the level of the tapping platform via pulling elements, not shown, which slide upward and downward on tow bars. The tow bars are fastened to supports of the main runner 2.

Figure 3:
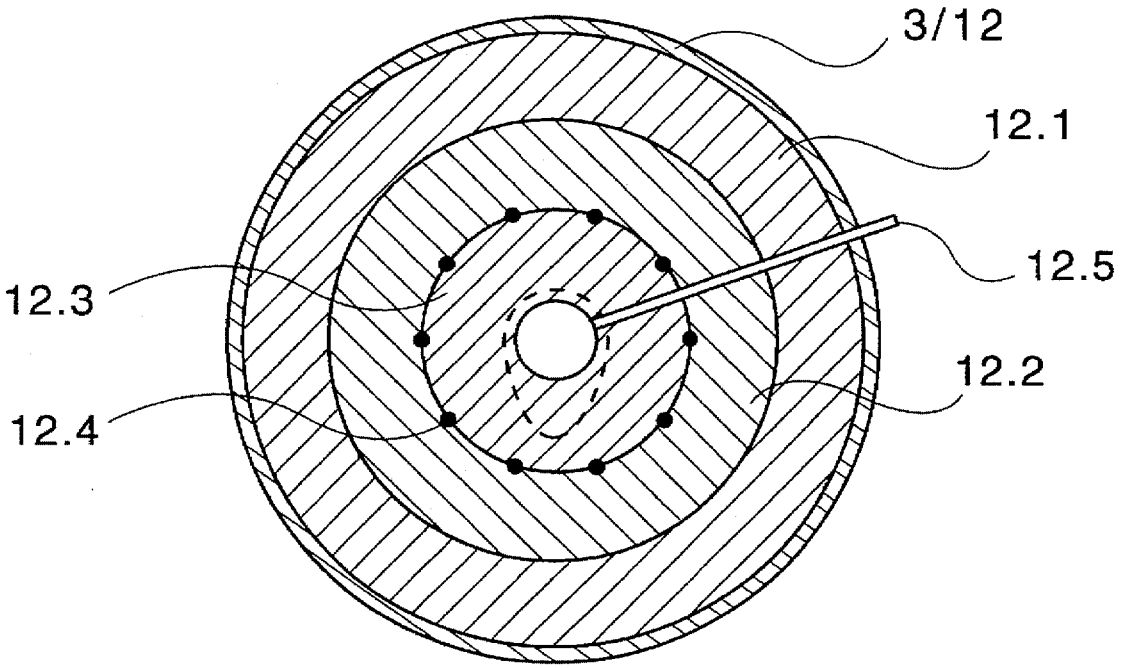
FIG. 3 is a cross section through a pipe section lined with refractory material.

FIG. 3 shows the cross section through a pipe section 3/12 lined with refractory material. The refractory material is composed of an insulating layer 12.1, the outer lining 12.2, and the wear lining 12.3.

A wire screen 12.4, which is connected to an electrical monitoring device via a metal pin 12.5 to monitor the state of the wear lining 12.3, is inserted at the transition from the outer lining 12.2 to the wear lining 12.3.

Figure 4:
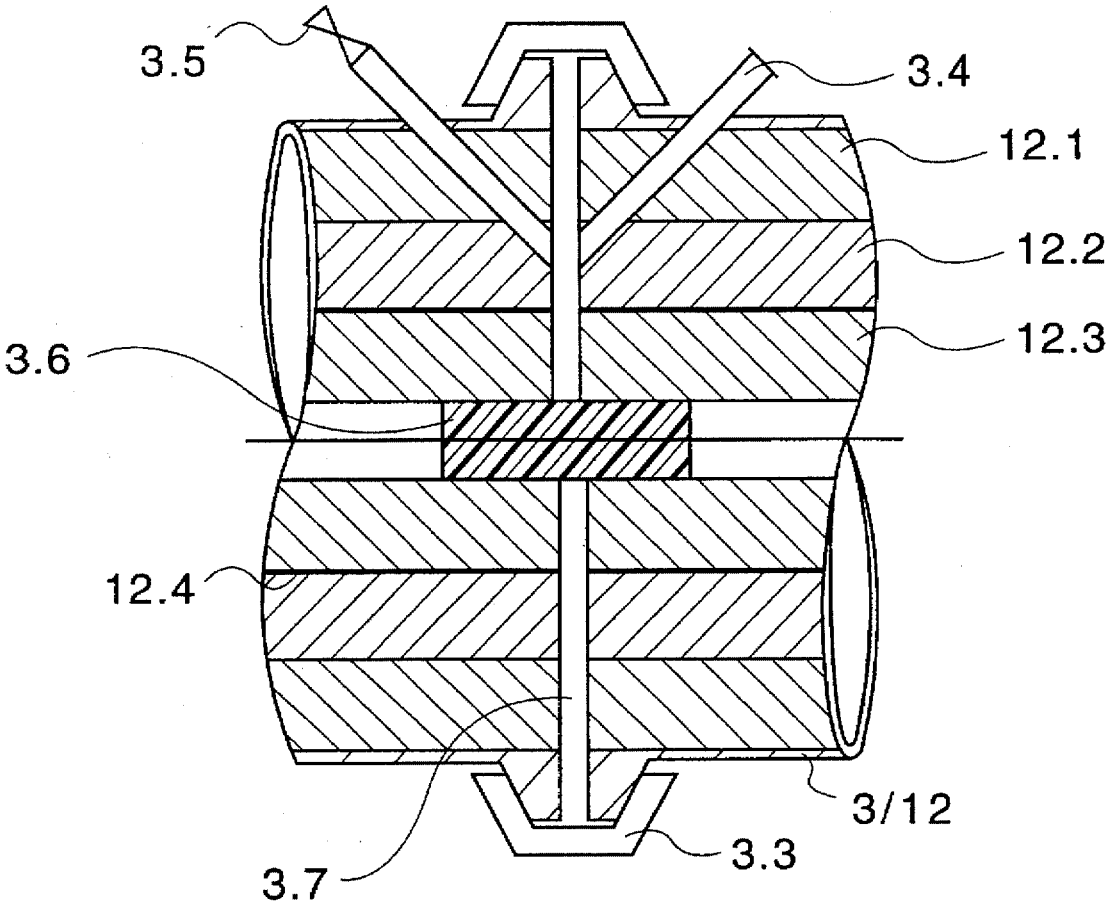
FIG. 4 is a cross section with the arrangement of the seal between two pipe sections.

FIG. 4 shows means for sealing two pipe sections 3 or 12.

A pipe clamp 3.3, which is provided on each side with a feed line 3.4 with shut-off valve 3.5 to press a sealing compound 3.7 into the remaining free gap between the lined pipe sections 3 or 12, is placed around the flanges of the two pipe sections 3 or 12.

A plastic plug 3.6 is inserted into the free cross section of the wear lining 12.3 before the pipe sections 3 or 12 are joined to prevent the sealing compound 3.7 from blocking or constricting the free cross section of the wear lining 12.3.

The process for operating a device for transporting molten metal in the pouring bay of a shaft furnace, especially a blast furnace, in accordance with the invention achieves opening and closing of the runout at the correct time for accurately metering the amount of molten metal.

The plugged taphole 1.3 is opened with the taphole boring machine 10 drilling out the hardened plugging composition within the pipe section 3 of the taphole 1.3 and drilling out the runout 1.2, after opening the ceramic plate of the sliding shutter 6 and after opening the closing cap 8 on the top side of the cover hood 9 of the main runner 2.

After opening the taphole 1.3, a flow of molten metal flows through the pipe section 3, the opened sliding shutter 6, and the intake opening 2.1 into the gas-tightly screened main runner 2 with the skimmer 11. After separation of the slag, the flow of pig iron flows through the discharge opening 2.2 and through at least one metal pipe 12 into a T-shaped pipe section 13 and it reaches from there a pig iron transfer car 18 via one of the opened sliding shutters 6 through a elbow 14.

Immediately (substantially immediately) after closing a sliding shutter 6 arranged in the pipe section 3, the taphole 1.3 is cleared of molten metal by rinsing by means of an inert gas, and this state is maintained by setting a specific inert gas flow rate.

The plugging/repairing of the taphole 1.3 washed out by the flow of molten metal or for replacing the ceramic plate of the sliding shutter 6, the taphole 1.3 of the runout 1.2 is cleared by rinsing by means of an inert gas. The connecting branch 3.1 of the pipe section 3 is drilled by means of a drill bit of a stationary boring machine 4 to clear it of hardened plugging composition. The drill bit of the boring machine 4 drills a channel into the hardened plugging composition of the taphole 1.3 and then clears the connecting branch 3.2 of the taphole gun 5 by drilling.

To introduce plugging composition through the taphole gun 5 via the connecting branch 3.2, plugging compositions are moved within the pipe section 3 in the direction of the taphole 1.3, the connecting branch 3.1 and the ceramic plate of the sliding shutter 6, but the ceramic plate of the sliding shutter is protected from the further advancement of the plugging composition and is kept free for replacement by an inert gas blanket.

To avoid pig iron runs in joints after repair work, the pipe sections 3, the metal pipe sections 12, the T-shaped pipe section 13, and the elbow 14 are connected tightly by introducing a plastic plug 3.6 and a sealing compound 3.7.

While specific embodiments of the invention have been shown and described in detail to illustrate the application of the principles of the invention, it will be understood that the invention may be embodied otherwise without departing from such principles.

What is claimed is:

1. A device for transporting molten metal in the pouring bay of a shaft furnace, the device comprising:

a main runner with a siphon/skimmer, said main runner being installed at a runout of a tapping door of the furnace;

runoff gutters arranged downstream of said main runner, as well as a transfer station for transfer into a molten metal transport vessel or transfer car;

a flanged pipe section including a first connecting branch and a second connecting branch for a taphole gun, said flanged pipe being provided between said runout on the furnace and said main runner;

inert gas supply means for supplying inert gas;

a slide with a ceramic plate, said slide and said inert gas supply means being arranged between said flanged pipe section and an intake opening of said main runner;

cover hood and flap means for sealing said main runner with said siphon/skimmer in a gas-tight manner;

another slide with a ceramic plate arranged between a discharge opening of said main runner and a metal pipe section;

a T-shaped pipe section;

a first elbow and a second elbow;

a metal pipe arranged between said another slide and said T-shaped pipe section; and a first further slide arranged between said T-shaped pipe section and said first elbow and a second further slide arranged between said T-shaped pipe section and said second elbow.

2. A device in accordance with claim 1, wherein said inert gas supply means arranged at said intake opening, said discharge opening, and said flap.

3. A device in accordance with claim 1, further comprising an inert gas screen provided at said elbows.

4. A device in accordance with claim 1, further comprising a stationary boring machine provided at said first connecting branch, a stationary taphole gun provided at said second connecting branch; and a stationary taphole boring machine provided above said hood at said flap.

5. A device in accordance with claim 1, further comprising a pipe clamp with laterally arranged feed lines and said shut-off valves for sealing pipe sections of said ranged pipe section, said pipe section with said sliding shutter as well as said metal pipe section among each other, said T-shaped pipe section with a said metal pipe section or with one of said elbows.

6. A device in accordance with claim 1, further comprising a wire screen as well as a metal pin of an electric measuring device are provided in each of said flanged pipe section, said pipe section with said sliding shutter, said T-shaped pipe section and said elbows at a transition from an outer lining to a wear lining.

7. A device in accordance with claim 1, further comprising a burner arranged on one of said pipe sections.

8. A device in accordance with claim 1, wherein the said main runner (2) is equipped as a quick-change runner.

9. A device for transporting molten metal in the pouring bay of a shaft furnace, the device comprising:

a main runner with a siphon/skimmer, said main runner being installed at a runout of a tapping door of the furnace;

runoff gutters arranged downstream of said main runner, as well as a transfer station for transfer into a molten metal transport vessel or transfer car;

a boring machine;

a taphole gun;

a flanged pipe section including a connecting branch for said boring machine and a connecting branch for a taphole gun, said flanged pipe being provided between said runout on the furnace and said main runner;

inert gas supply means for supplying inert gas;

a slide with a ceramic plate, said slide and said inert gas supply means being arranged between said flanged pipe section and an intake opening of said main runner;

cover hood and flap means for sealing said main runner with said siphon/skimmer in a gas-tight manner;

another slide with a ceramic plate arranged between a discharge opening of said main runner and a metal pipe section;

a T-shaped pipe section;

a first elbow and a second elbow;

a metal pipe arranged between said another slide and said T-shaped pipe section; and a first further slide arranged between said T-shaped pipe section and said first elbow and a second further slide arranged between said T-shaped pipe section and said second elbow.

10. A process for operating a device for transporting molten metal in the pouring bay of a shaft furnace, for achieving opening and closing of the runout at the correct time for accurately metering the amount of molten metal, the process comprising the steps of:

drilling out hardened plugging composition within a pipe section of a taphole and drilling out a runout of the furnace to open the plugged taphole using a taphole boring machine after opening a ceramic plate of a sliding shutter and after opening a closing cap on a top side of a cover hood of the main runner;

after opening said taphole, allowing a flow of molten metal to flow through said pipe section, through said opened sliding shutter, and through said intake opening and into said main runner, while said main runner is maintained gas-tightly screened, the main runner being provided with a skimmer;

separating slag, and allowing pig iron to flow through a discharge opening of said main runner and through at least one metal pipe into a T-shaped pipe section and allowing the pig iron to reach a pig iron transfer car via an elbow and an opened sliding shutters disposed between said T-shaped pipe section and said elbow;

closing said sliding shutter arranged in said pipe section and substantially immediately thereafter clearing said taphole of molten metal by rinsing by means of an inert gas, and maintaining this state by setting a specific inert gas flow rate;

and plugging/repairing said taphole washed out by the flow of molten metal or for replacing the ceramic plate of said sliding shutter, including cleaning and rinsing said taphole of said runout by means of an inert gas, drilling a connecting branch of said pipe section with a drill bit of a stationary boring machine to clear it of hardened plugging composition, drilling a channel into the hardened plugging composition of said taphole with the drill bit of said boring machine and then clearing another connecting branch, of a taphole gun;

introducing plugging composition through said taphole gun via said another connecting branch, to move plugging compositions within the said pipe section in the direction of said taphole, said connecting branch and the ceramic plate of the said sliding shutter, while protecting said ceramic plate of the said sliding shutter from the further advancement of the plugging composition and is kept free for replacement by an inert gas blanket.

11. A process in accordance with claim 10, wherein to avoid pig iron runs in joints after repair work, said pipe sections, the said metal pipe sections, the said T-shaped pipe section, and said elbow are connected tightly by introducing a plastic plug and a sealing compound.

* * * * *